United States Patent [19]

Schäfer et al.

[11] Patent Number: 4,599,195

[45] Date of Patent: Jul. 8, 1986

[54] SOLUTION AND METHOD FOR REMOVING PROTEIN, LIPID, AND CALCIUM DEPOSITS FROM CONTACT LENSES

[75] Inventors: Doris Schäfer; Rolf Schäfer, both of Arisdorf, Switzerland

[73] Assignee: Alcon Laboratories, Inc., Fort Worth, Tex.

[21] Appl. No.: 687,274

[22] Filed: Dec. 28, 1984

[51] Int. Cl.[4] ..... C11D 1/06; C11D 3/33

[52] U.S. Cl. ..... 252/546; 252/142; 252/174.19; 252/174.21; 252/DIG. 14

[58] Field of Search ..... 252/106, 174.21, 174.12, 252/DIG. 12, DIG. 14, 142, 546, 174.19; 514/839

[56] References Cited

U.S. PATENT DOCUMENTS

| | | | |
|---|---|---|---|
| 2,183,153 | 12/1939 | Haussmann et al. | 260/404 |
| 3,171,752 | 3/1965 | Rankin | 106/194 |
| 3,183,152 | 5/1965 | Szekely et al. | 167/59 |
| 3,240,709 | 3/1966 | Rankin | 252/106 |
| 3,311,577 | 3/1967 | Rankin | 260/17 |
| 3,539,520 | 11/1979 | Cantor et al. | 252/106 |
| 3,549,747 | 12/1970 | Krezanoski et al. | 424/78 |
| 3,639,576 | 2/1972 | Kaspar et al. | 424/78 |
| 3,755,561 | 8/1973 | Rankin | 424/78 |
| 3,767,788 | 10/1973 | Rankin | 424/78 |
| 3,856,919 | 12/1974 | Rankin | 424/78 |
| 3,882,036 | 5/1975 | Krezanoski et al. | 252/106 |
| 3,910,296 | 10/1975 | Karageozian et al. | 134/2 |
| 3,947,573 | 3/1976 | Rankin | 424/80 |
| 3,954,644 | 5/1976 | Krezanoski et al. | 252/106 |
| 4,046,706 | 9/1977 | Krezanoski | 252/106 |
| 4,096,870 | 6/1978 | Manfuso, Jr. | 252/136 |
| 4,127,423 | 11/1978 | Rankin | 134/30 |
| 4,152,283 | 5/1979 | Cordrey et al. | 252/99 |
| 4,285,738 | 8/1981 | Ogata | 134/26 |
| 4,311,618 | 1/1982 | Schafer-Burkhard | 252/542 |
| 4,356,100 | 10/1982 | Sherman | 252/106 |
| 4,395,346 | 7/1983 | Kleist | 252/135 |
| 4,407,791 | 10/1983 | Stark | 424/80 |
| 4,410,442 | 10/1983 | Lucas et al. | 252/107 |
| 4,421,665 | 12/1983 | Lloyd et al. | 252/106 |
| 4,440,662 | 4/1984 | Tsuzuki et al. | 252/106 |
| 4,546,123 | 10/1985 | Schäfer et al. | 523/106 |

FOREIGN PATENT DOCUMENTS

| | | |
|---|---|---|
| 0102118 | 7/1984 | European Pat. Off. . |
| 3320340 | 12/1983 | Fed. Rep. of Germany . |

*Primary Examiner*—Prince E. Willis

*Attorney, Agent, or Firm*—James A. Arno; Gregg C. Brown

[57] ABSTRACT

A nontoxic, aqueous, contact lens cleaning solution containing a mixture which includes a nonionic or weakly anionic surfactant, a chelating agent, a source of hydrated protons, and optionally also urea; and a method of chemically removing protein, lipid and calcium deposits from contact lens utilizing this solution are described.

5 Claims, No Drawings

SOLUTION AND METHOD FOR REMOVING PROTEIN, LIPID, AND CALCIUM DEPOSITS FROM CONTACT LENSES

BACKGROUND OF THE INVENTION

1. Field of the Invention

The present invention relates to the removal of deposits from contact lenses, particularly soft contact lenses. More specifically, the present invention relates to an aqueous contact lens cleaning solution and to a method for removing protein, lipid, and calcium deposits from contact lenses using this solution.

2. Description of the Prior Art

The solution and method of the present invention are especially useful in removing deposits from soft contact lenses. The "soft" lenses referred to herein are generally those lenses formed from a soft and flexible material. Although the present invention is not directed toward the manufacture of soft contact lenses, it should be noted as general background for this invention that various materials and methods for producing soft contact lenses have been described in the art. For example, U.S. Pat. Nos. 3,503,393 and 2,976,576 describe the use of various polymeric hydrogels based on acrylic esters in the manufacture of soft contact lenses. It is also known in the art that soft contact lenses may be based on silicone and other optically suitable flexible polymers. The general physical characteristics of soft contact lenses are due at least in part to the fact that these lenses absorb a high percentage of water. Due to this hydration, the polymer swells to form a soft and flexible material, thereby resulting in a physically stable material capable of maintaining its shape and dimensions.

One of the major problems associated with the use of soft contact lenses is the formation of deposits when these lenses are worn on the human eye. The composition of these deposits is complicated and varies from patient to patient; however, the deposits are believed to primarily consist of proteins, lipids and calcium. The deposits may form both on the lens surface and beneath the lens surface. The buildup of material on and below the surface of the lens creates discomfort and irritation in the eye of the patient.

The material attached at the lens surface can be removed by mechanically rubbing the lens with cleaning solutions containing microspheres and other chemical agents. However, repeated cleaning of the lens in this manner may result in physical damage to the lens surface, which damage can be identified microscopically as scratches, depending on the nature of the microspheres or beads utilized in the solutions, for example. Moreover, it is generally either difficult or impossible to remove deposits located beneath the lens surface using prior art cleaning solutions and mechanical rubbing of the lens.

The deposits attached to the lens surface consisting of proteinaceous material can be removed by enzymes; see in this regard U.S. Pat. Nos. 3,910,296 and 4,096,870. Also, molecular mechanisms for removing cross-linked (denatured) proteins from lens surfaces with chemical cleaners are described in detail in U.S. Pat. No. 4,311,618. However, nonproteinaceous and proteinaceous materials beneath the lens surface are generally more difficult to remove with enzyme or chemical cleaners.

SUMMARY OF THE INVENTION

It is an object of the present invention to provide a solution and method for removing protein, lipid and calcium deposits from the surface and subsurface areas of contact lenses.

In order to fulfill the above-stated objective as well as other general objectives of the present invention, there is provided an aqueous contact lens cleaning solution comprising a mixture which includes a surfactant selected from the group consisting of nonionic surfactants of formula:

$$HO-(CH_2-CH_2-O)_x-(\underset{\underset{CH_3}{|}}{CH}-CH_2-O)_y-(CH_2-CH_2-O)_x-H$$

in which y is a whole number from 10 to 50 and x is a whole number from 5 to 20, and anionic surfactants of formula:

$$R\text{-}O\text{-}(CH_2\text{-}CH_2\text{-}O)_z\text{-}CH_2\text{-}COOH$$

in which R is a $C_8$ to $C_{18}$ hydrocarbon chain and z is a whole number from 1 to 25, a calcium chelating agent, and a source of hydrated protons; the solution may optionally also contain urea. A method of cleaning contact lenses using this solution is also provided.

The compounds contained in the above described mixture act synergistically to remove protein, lipid, and calcium deposits from contact lenses, particularly soft contact lenses.

DETAILED DESCRIPTION OF THE INVENTION

As discussed above, the formation of deposits on human worn soft contact lenses is a well known problem. The formation of such deposits is greatly dependent on the individual patient. These deposits are generally formed after an extended wearing period, but may be formed after only a relatively short period such as one day or less. In general, the material which deposits on soft contact lenses originates from the tear fluid, and consists of insoluble proteinaceous material, lipids, and calcium. Calcium may be deposited as inorganic calcium salts, or as calcium-lipid and calcium-protein complexes.

The exact composition of the material which is deposited also varies from patient to patient. For example, the lenses of some patients may contain primarily calcium deposits, while lenses of other patients may include a preponderance of proteinaceous material. Due to the high water content of soft contact lenses, the material is not only deposited on the lens surface, but also below the lens surface, thereby creating cavities in the polymeric hydrogels. Such material is generally difficult to remove with either the mechanical/chemical or enzymatic treatment methods of the prior art.

This invention relates to nontoxic, aqueous lens cleaning solutions containing synergistic combinations of surfactants, calcium chelating agents, and hydrated protons, and optionally also urea. The surfactant component comprises one or more compounds selected from the group consisting of nonionic compounds of formula:

$$HO-(CH_2-CH_2-O)_x-(\underset{\underset{CH_3}{|}}{CH}-CH_2-O)_y-(CH_2-CH_2-O)_x-H$$

in which y is a whole number from 10 to 50, preferably 30, and x is a whole number from 5 to 20, preferably 10, and weakly anionic dissociating compounds of formula:

$$R\text{-}O\text{-}(CH_2\text{-}CH_2\text{-}O)_z\text{-}CH_2\text{-}COOH$$

in which z is a whole number from 1 to 25, preferably 10, 13, or 16 and R is a $C_8$ to $C_{18}$ hydrocarbon chain, preferably a $C_{12}$ hydrocarbon chain.

The above-described surfactants are commercially available. For example, the above-identified nonionic surfactants are available under the name "PLURIOL" from BASF, Ludwigshafen, West Germany. The physical properties of these nonionic surfactants are further-described in technical information sheets available from BASF. The above-identified anionic surfactants are commercially available under the name "AKYPO (RLM)" from CHEM-Y, Emmerich, West Germany. The physical properties and other characteristics of these anionic surfactants are further described in European Patent Application No. 83201182.9, filed Aug, 10, 1983, and published as Publication No. 0 102 118 on Mar. 7, 1984. A preferred anionic surfactant of the above-described type is AKYPO RLM 100. A preferred nonionic surfactant of the above-described type is PLURIOL L 64. The amount of surfactant contained in the lens cleaning solutions is typically in the range of from about 0.02% to 1% (w/v), preferably from about 0.2% to 0.6%.

The commercially available surfactants normally contain impurities which can be removed using conventional techniques such as, for example, molecular exclusion chromatography in the case of the nonionic surfactants and ion exchange chromatography in the case of the anionic surfactants.

The calcium chelating agents utilized in the present invention must be capable of sequestering calcium in a manner such that calcium deposits are effectively removed from the lenses undergoing treatment. Such chelating agents are generally inorganic or organic acids, such as polycarboxylic acids. Chelating agents of this type are described in *Special Publication No.* 17: "Stability Constants of Metal-Ion Complexes," The Chemical Society (London, 1964); the entire contents of this reference relating to the physical properties and other characteristics of such calcium chelating agents are incorporated herein by reference. The preferred chelating agents are polycarboxylic acids, particularly citric acid and ethylenediaminetetraacetic acid (EDTA). A combination of citric acid and EDTA is especially preferred as the calcium chelating agent component of the present solutions. The amount of chelating agent contained in the lens cleaning solutions is typically from about 0.005% to 0.5% (w/v), preferably from about 0.05% to 0.2%.

The source of hydrated protons comprises one or more inorganic or organic acids capable of providing free hydrogen ions when in solution at acidic pH. As mentioned again below, these hydrogen ions facilitate removal of protein deposits from the lenses. Citric acid and EDTA are preferred as the source of hydrated protons. This preference is based on, inter alia, formulation simplification, since-utilizing these acids as the source of hydrated protons enables the chelating agent and source of hydrated proton functions to be performed by a single compound or compounds. However, other acids such as, for example, sodium dihydrogen phosphate or gluconic acid may also be utilized. The acid or acids utilized as the source of hydrated protons are preferably contained in the present solutions in an amount sufficient to render the solutions slightly acidic, e.g., a pH of about 6.5.

Urea is an optional ingredient in the lens cleaning solutions of the present invention. As mentioned again below, urea has been found to be effective in removing both surface and sub-surface deposits of lipids and proteins when utilized in relatively high concentrations, such as 10% w/v or greater. Conversely, it has also been found that urea is somewhat less effective in removing these deposits when utilized in relatively low concentrations. Accordingly, the optional inclusion of this compound in the present solutions will normally be determined by factors such as the severity of the lens deposits and whether the lenses are being cleaned in vitro or directly in the eye. If included, the amount of urea contained in the lens cleaning solutions is typically from about 0.02% to 1% (w/v), preferably from about 0.2% to 0.6%.

It has been observed that high concentrations of urea (i.e., 10% w/v) are able to rapidly remove proteinaceous and lipid deposits on and beneath the surface of human worn soft contact lenses at temperatures between 20° C. and 80° C. Similarly, high concentrations (10% w/v) of the above-cited nonionic and anionic surfactants are able to rapidly remove proteinaceous and lipid deposits from lenses at temperatures between 20° C. and 80° C. It has also been observed that high concentrations of EDTA (2.5% w/v) and citric acid (2.5% w/v) are able to remove calcium deposits from lenses at room temperature.

It has now surprisingly been found that mixtures of the above compounds are able to remove protein, lipid and calcium deposits at much lower temperatures and concentrations than those required when these compounds are utilized individually. Thus, it has been found that these compounds act synergistically in removing lens deposits. It should be noted that this synergism is seen both with and without the inclusion of urea in the mixtures. At low concentrations (i.e., up to 1% w/v) these mixtures do not act as irritants in the eye and do not cause discomfort after corneal application. Consequently, lens cleaning solutions containing these mixtures in low concentrations are capable of removing deposits from lenses while the lenses are being worn. This capability is a significant feature of the present solutions.

While applicant does not wish to be bound to any particular theory, it is believed that urea changes the molecular conformation of the protein deposits to a less folded aminoacid polymer and converts deposited lipid into a more water soluble clathrate; the surfactants are believed to emulsify the unfolded protein and the lipid clathrate; the chelating agents are believed to remove inorganic and organic calcium deposits by means of salt formation; and the hydrated protons are believed to promote the entire cleaning process through protonation of the deposited proteins. (Reference is made to the following articles for a further discussion concerning the formation of clathrates and alteration of water structure in aqueous solutions containing urea: R. Hinnen et al., *European Journal of Biochemistry*, Vol. 50, pages 1–14 (1924); and R. Marschner, *Chemical & Engineering* News, Vol. 6, pages 495–508 (1955).)

According to the present invention nontoxic, aqueous cleaning solutions containing a mixture of the above-described compounds are provided. This mixture may be included in the lens cleaning solutions of the present invention at concentrations of, for example, 1% to 50% (w/v), preferably 1% to 10% (w/v) for the active removal of heavy lens deposits outside of the eye, 0.1% to 10% (w/v), preferably 0.1% to 1% (w/v) for daily cleaning of lenses outside of the eye, and 0.01% to 1% (w/v), preferably 0.01% to 0.4% (w/v) for cleaning lenses while being worn in the eye. A convenient feature of the present solutions is the fact that the solutions may be provided in a concentrated form which can be easily diluted with a suitable diluent (e.g., saline solution) to adapt the solution to a particular use. It should be noted that these concentrated solutions may contain higher concentrations (w/v%) of the individual components making up the mixture than the concentrations described above in connection with each of these components. The solutions of the present invention which are adapted for cleaning contact lenses directly in the eye are formulated as isotonic or hypotonic solutions. Typically the lens cleaning solutions of this invention may also include conventional formulatory ingredients, such as, preservatives, viscosity enhancing agents and buffers.

The present invention also provides a method of cleaning contact lenses. This method comprises contacting the lenses with the lens cleaning solutions of the present invention. A preferred method of cleaning lenses outside of the eye comprises placing the lenses in a suitable container with an amount of the above-described cleaning solution sufficient to cover the lenses, and then soaking the lenses at room temperature for a period of about 5 minutes to 24 hours, preferably 1 to 12 hours, or for shorter periods at elevated temperatures, e.g., 0.5 to 6 hours at 37° C. A preferred method of cleaning lenses while in the eye comprises applying one to two drops of a diluted cleaning solution to the lenses three or four times per day or as needed to effect cleaning of the lenses.

The following examples further illustrate the present invention, but should not be interpreted as limiting the scope of the invention in any way.

EXAMPLE 1

The lens cleaning solutions of the present invention may be prepared, for example, as follows. First, 10 g of purified PLURIOL L 64 is added to 60 mL of distilled water and completely dissolved by means of stirring. Next, 2.5 g ethylenediaminetetraacetic acid, 2.5 g citric acid and 10 g urea are added to the solution. The pH of the solution is then adjusted to pH 6.3–6.5 with 10ON NaOH, and the volume of the solution is adjusted to 100 mL with distilled water to provide a 25% (w/v) lens cleaning solution. The solution may be made isotonic by adding NaCl, and may be diluted to lower concentrations by adding distilled water. The same preparation procedure may be followed in order to produce cleaning solutions containing AKYPO RLM 100, or any of the other nonionic or anionic surfactants identified above.

EXAMPLE 2

Ten heavily deposited, soft contact lenses which had been worn for an extended period were soaked at 37° C. for two hours in an aqueous isotonic solution containing 10% (w/v) urea, 10% (w/v) AKYPO RLM 100, 2.5% (w/v) ethylenediaminetetraacetic acid and 2.5% (w/v) citric acid, which solution had its pH adjusted to 6.4 with NaOH. After soaking, the lenses were equilibrated against saline. The deposits were completely removed, as shown by microscopic examination.

EXAMPLE 3

Twelve heavily deposited soft contact lenses which had been worn for an extended period were soaked at 25° C. for three hours in an aqueous, isotonic solution containing 10% (w/v) urea, 10% (w/v) PLURIOL L 64, 2.5% (w/v) ethylenediaminetetraacetic acid and 2.5% (w/v) citric acid, which solution had its pH adjusted to 6.2 with NaOH. Microscopic examination of the lenses after equilibration against saline revealed complete removal of lens deposits.

EXAMPLE 4

Five heavily deposited soft contact lenses were treated first with a proteolytic enzyme cleaner. After this treatment, four of these lenses still contained deposits which had not been removed by the proteolytic enzyme. These four lenses were then subjected to the treatment described in Example 2. Microscopic examination subsequent to this treatment revealed that the enzyme resistant deposits had been removed.

EXAMPLE 5

In order to quantitatively demonstrate the effectiveness of the present solutions in removing lens deposits, three heavily deposited lenses of the type subjected to treatment in Example 2 and three lenses of the type subjected to treatment in Example 4 were neutron activated. This neutron activation altered calcium to $Ca^{45}$ and phosphorus to $P^{32-33}$, both of which are beta-emitters. The beta emissions generated by the activated calcium and phosphorus enabled a quantitative measurement of the calcium, phospholipid and phosphoprotein deposits present on the lenses to be made. These measurements revealed that the first group of lenses, the untreated lenses of the type utilized in Example 2, emitted approximately 14,000±2,000 counts per minute (cpm), while the second group of lenses, the enzyme treated lenses of the type utilized in Example 4, emitted approximately 3,500±1,000 cpm. The first group of lenses were then treated in the manner described in Example 2 and the second group of lenses were soaked in a tenfold dilution of the solution described in Example 3 for one hour at room temperature. Following these treatments, the radioactivity of the lenses decreased dramatically to approximately 80–130 cpm and 30–70 cpm, respectively. These quantitative test results further demonstrate the effectiveness of the present solutions in removing calcium, lipid and protein deposits from contact lenses.

The present invention has been described above in connection with certain preferred embodiments. However, as obvious variations thereon will become apparent to those skilled in the art, the invention is not to be considered as limited thereto.

What is claimed is:

1. An aqueous contact lens cleaning solution, comprising an effective amount of an anionic surfactant formula:

$$R\text{-}O\text{-}(CH_2\text{-}CH_2\text{-}O)_z\text{-}CH_2\text{-}COOH$$

in which R is a $C_8$ to $C_{18}$ hydrocarbon chain and z is a whole number from 1 to 25; an effective amount of a calcium chelating agent selected from the group consisting of citric acid, ethylenediaminetetraacetic acid and combinations thereof; and a source of hydrated protons to facilitate removal of protein deposits from contact lenses, said source of hydrated protons comprising an acid capable of providing free hydrogen ions when in solution at acid pH in an amount sufficient to render the aqueous contact lens cleaning solution slightly acidic, said acid being selected from the group consisting of citric acid, ethylenediaminetetraacetic acid, sodium dihydrogen phosphate, gluconic acid and combinations therof.

2. The aqueous contact lens cleaning solution of claim 1, wherein the solution comprises from about 0.02 to 1.0 weight/volume percent of the anionic surfactant and from about 0.005 to 0.5 weight/volume percent of the calcium chelating agent.

3. The aqueous contact lens cleaning solution of claim 1, wherein R is a $C_{12}$ hydrocarbon chain and z is 10.

4. The aqueous contact lens cleaning solution of claim 1, wherein the calcium chelating agent comprises ethylenediaminetetraacetic acid.

5. A method of cleaning a contact lens which comprises applying the contact lens cleaning solution of claim 1 to the lens.

* * * * *

UNITED STATES PATENT AND TRADEMARK OFFICE

CERTIFICATE OF CORRECTION

PATENT NO. : 4,599,195

DATED : July 8, 1986

INVENTOR(S) : Doris Schafer et al

It is certified that error appears in the above-identified patent and that said Letters Patent is hereby corrected as shown below:

IN THE SPECIFICATION

Column 3, line 28 after "March 7, 1984", insert--
and U.S. Patent 2,183,853--.

Signed and Sealed this

Twenty-eighth Day of October, 1986

[SEAL]

*Attest:*

DONALD J. QUIGG

*Attesting Officer*

*Commissioner of Patents and Trademarks*